US005791277A

United States Patent [19]

Henderson et al.

[11] Patent Number: 5,791,277

[45] Date of Patent: Aug. 11, 1998

[54] RUDDER

[76] Inventors: Glenn Henderson, 2538 55th Ave. N., St. Petersburg, Fla. 33714; Paul Amon, 18 Fairview Dr., Moka Maraval Trinidad, Wis.

[21] Appl. No.: 733,648

[22] Filed: Oct. 17, 1996

[51] Int. Cl.[6] ..... B63H 25/06

[52] U.S. Cl. ..... 114/162

[58] Field of Search ..... 114/144 R, 153, 114/162, 132, 133, 134, 135, 136

[56] References Cited

U.S. PATENT DOCUMENTS

| | | | |
|---|---|---|---|
| 336,365 | 2/1886 | Welch | 114/136 |
| 3,001,502 | 6/1961 | Stoker | 114/162 |
| 3,867,897 | 2/1975 | Yamamoto | 114/167 |
| 3,913,159 | 10/1975 | Thomas | 114/162 |
| 4,377,124 | 3/1983 | Guigan | 114/132 |
| 4,401,047 | 8/1983 | Auras | 114/136 |
| 5,346,315 | 9/1994 | Strong et al. | 114/169 |

*Primary Examiner*—Stephen Avila
*Attorney, Agent, or Firm*—Breffni Baggot

[57] ABSTRACT

An inboard rudder 6 harbors within a bearing assembly 12 which passes vertically from a hull 10 of a boat 2 to a cockpit floor 8 of the boat 2 such that the inboard rudder 6 can be rotated around a vertical (z) axis 7 by a tiller 14 and raised or lowered by pulling or pushing on the top of rudder 6. Rudder 6 can be rotated about an axis (y) parallel to the width of the boat 2, in the fore and aft direction, by pulling or pushing on tiller 14 thereby altering a sweep angle 28 of the rudder (FIG. 3). Rudder 6 can be rotated about an axis (x) perpendicular to the length of the boat 2.

9 Claims, 8 Drawing Sheets

RUDDER

TECHNICAL FIELD

This invention relates to rudders for boats, and in particular inboard rudders.

BACKGROUND OF THE INVENTION

A rudder is a planar device near the stern of a boat for steering the boat. Rudders come in two types. Outboard rudders are attached to the stern of the boat, usually at a hinge on the back of the boat. Inboard rudders are fixed within the stern and not attached to the rear of the boat. The invention of the present patent is related to an inboard rudder.

Design of a boat rudder requires a weighing of design characteristics: area of the rudder, balance and sweep angle. Area of the rudder is self-defining. The balance of a rudder is the force on a rudder tending to move the rudder to be in line with the forward motion of the boat. The sweep angle of a rudder is the angle of the rudder with a vertical axis through a rudder post.

This design usually results in a compromise—greater emphasis on one characteristic necessitates some yielding of one or more of the other characteristics. And yet, the rudder must be able to steer the boat under a variety of conditions—high boat speed, low boat speed, high wind speed, low wind speed, sailing into the wind, away from the wind, and all points of sail.

Designers have tried to improve the rudder. Stoker, U.S. Pat. No. 3001502, discloses a rudder whose effective area can be varied with boat speed because the rudder consists of a pair of vanes, wherein a first vane is nested within a second vane. As the speed of the boat is varied, the first vane emerges from within the second vane by rotating around a pivot pin that passes through the two vanes. As the first vane emerges from the second vane the area of the rudder is increased. Yamamoto, U.S. Pat. No. 3867897, shows another method of having a first vane emerge from a second one. The disadvantage of these designs is that they result in more drag, slowing the boat down. Particularly for sailing yachts used for racing, this is unacceptable.

Most of the load on an inboard rudder is carried by a rudder post by which the rudder is fastened to the boat. One key to an useful rudder is therefore the design of that post. If large loads are expected, that post should be thick. An alternative to a thick rudder post is one lengthened in the fore and aft dimension. Further, if a rudder has a variable area, as taught in Stoker and Yamamoto above, the force on the rudder will vary with the area of the rudder. The rudder post must be capable of handling light loads and heavy loads. If the rudder post is designed only for light loads, it will break under heavy loads. If the rudder post is designed for heavy loads, it will not break under heavy loads.

To achieve a strong rudder post without unduly increasing the weight of the boat, designers use exotic materials such as titanium and carbon fiber in the rudder post and rudder.

DISCLOSURE OF THE INVENTION

The object of the present invention is the elimination of what has historically been a key component in rudder design—the rudder post. A second objects is control of the rudder in three dimensions.

According to the present invention, an inboard rudder harbors within a bearing assembly which passes vertically from a hull of a boat to a cockpit floor of the boat such that the inboard rudder can be rotated around a vertical axis by a tiller and raised or lowered by pulling or pushing on the top of the rudder. In further accord with the present invention, the rudder can be rotated about an axis parallel to the width of the boat, in the fore and aft direction, by pulling or pushing on the tiller thereby altering a sweep angle of the rudder. In still further accord with the present invention, the rudder can be rotated about an axis perpendicular to the length of the boat.

There are advantages to the present invention. First, the rudder assembly includes no rudder post. This saves the cost of such a rudder post. Second, the rudder is capable of handling greater loads than rudders having rudder posts. This is because rudder loads are spread out over a single large bearing assembly housing the rudder instead of being carried by a smaller bearing and highly loaded rudder post. Third, the area of the rudder and therefore the force of the water on the rudder can by varied by raising or lowering the rudder. This can result in less drag on the rudder and a faster boat. Because rudder area dictates force on the rudder, the feel of the rudder sensed through the hand a sailor manning the tiller can be varied because raising or lowering the rudder can change the drive point of the rudder. In some circumstances, the force may be so reduced that the sailor can no longer sense with his hand the force on the rudder. Fourth, to compensate for this, the sweep angle of the rudder is variable by moving the tiller in the fore and aft dimension. Fifth, if the boat should heel to starboard or port, the rudder need not heel with the boat as do prior art rudders but can be rotated about an axis parallel to the length of the boat so that there is little loss of control during heeling.

These and other objects, features and advantages will become more apparent in light of the drawings and the corresponding text.

BEST MODE FOR CARRYING OUT THE INVENTION

Figure 1:
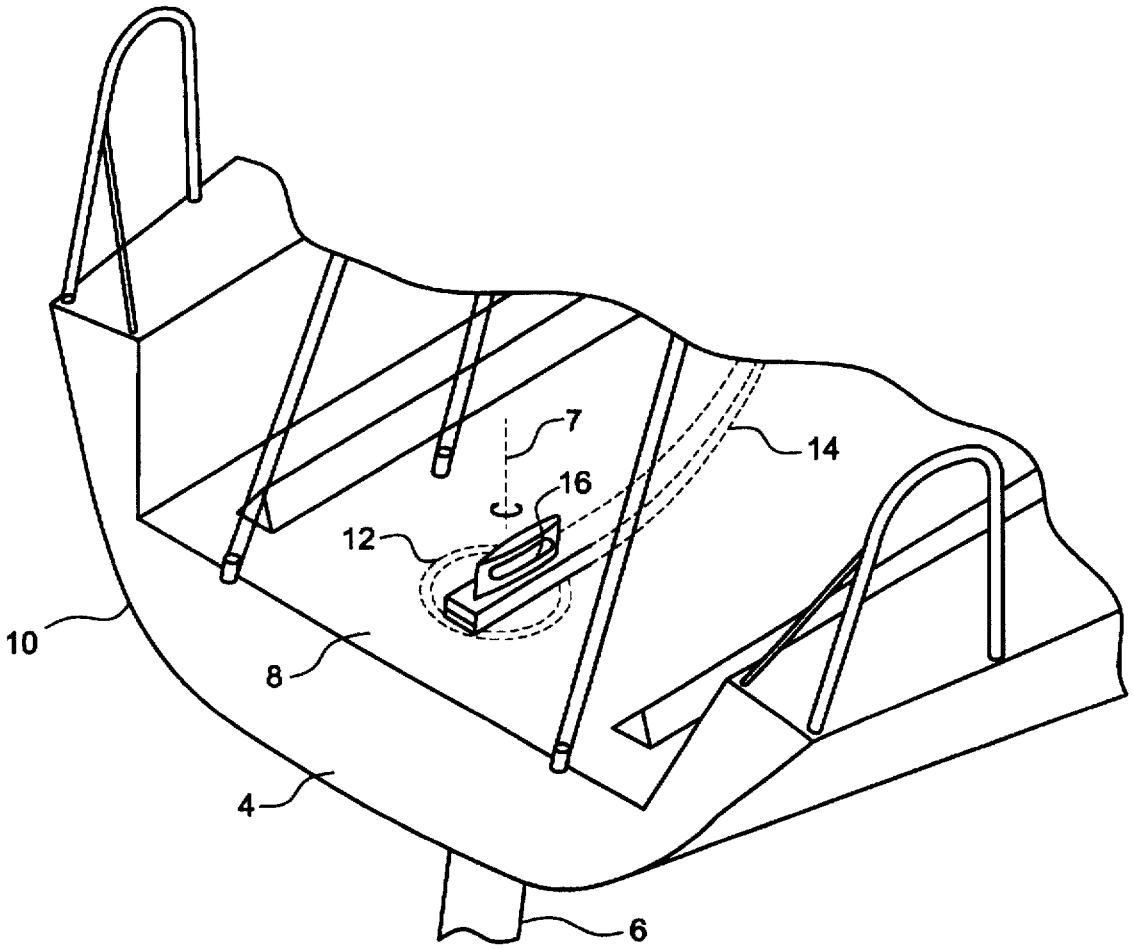
FIG. 1 is a perspective view of the invented rudder in a boat stern.

In FIG. 1, a boat 2 has a stern 4 and includes an inboard rudder 6 passing through a cockpit floor 8 of the boat 2 and emerging from a hull 10 of the boat 2. The rudder 6 rotates around a vertical axis 7 within a bearing assembly 12 which passes through the stern 4 of the boat 2.

The effective area of rudder 6 is the area which interacts with water beneath the hull 10. It can be varied by raising or lowering the rudder 6 by pulling up or pushing down on rudder handle 16.

Figure 2A:
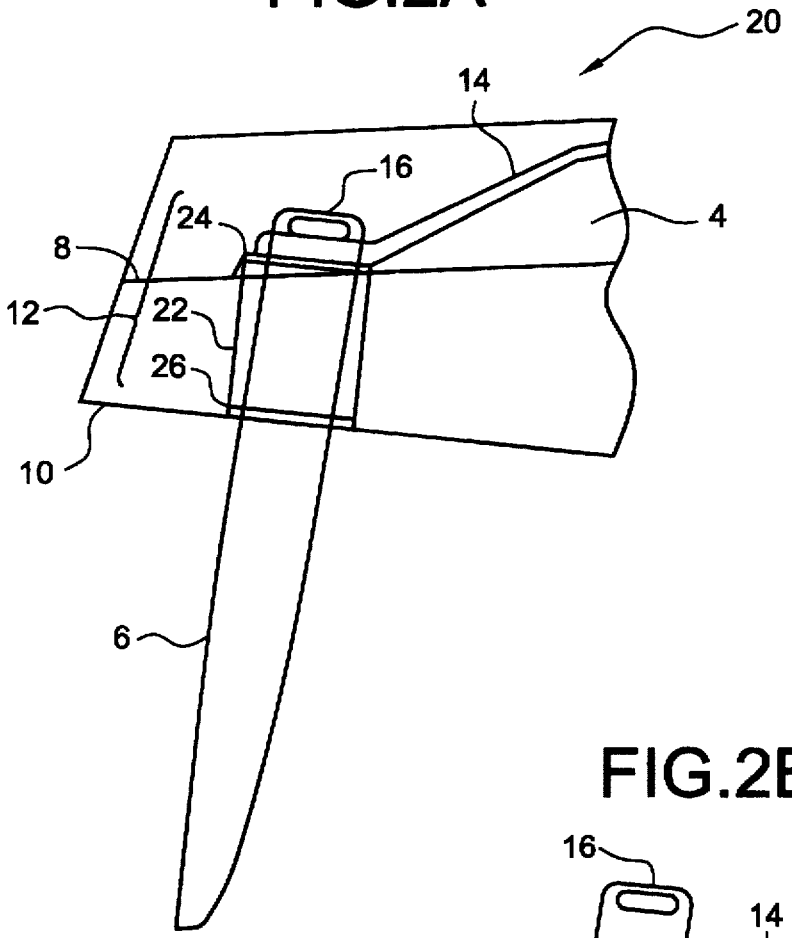
FIGS. 2A, B are side views of the rudder assembly of the present invention.
Figure 2B:
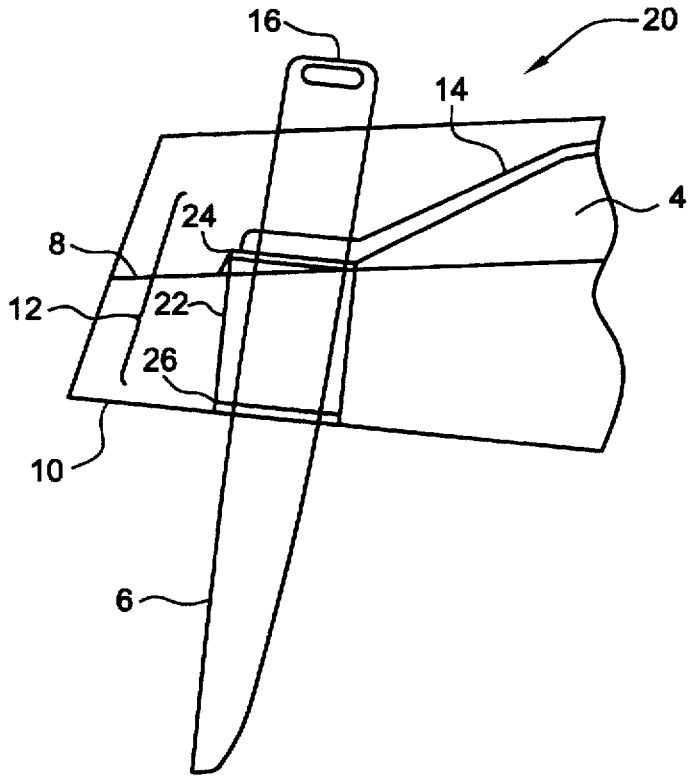

FIGS. 2A, 2B illustrate the structure of the rudder 6 in the stern 4 of the boat 2 with attention to that feature of the invention which allows variation of the effective area of rudder 6.

Whereas prior art rudders pivot around a rudder post, rudder 6 according to the present invention pivots around no rudder post but instead rotates within a single bearing assembly 12. This is a first feature of the present invention—that it requires no rudder post. Second, loads on rudder 6 are spread over the entire bearing assembly 12 rather than being applied to a single component such as a rudder post.

In FIG. 2A, a rudder assembly 20 is located in stern 4 and includes tiller 14 for turning rudder 6 which passes through tube 22. Tube 22 harbors in stern 4 and passes from hull 10 to cockpit floor 14. Rotation of rudder 6 occurs in response to movement of tiller 14. Bearing assembly 12 includes a top bearing plate 24, tube 22, and bottom bearing plate 26.

Rudder 6 includes handle 16 so that it can be raised or lowered as the sailing environment varies. For example, in a light wind rudder 6 can be raised until sailing conditions are varied to require a greater effective area at which point the rudder can be lowered. Whereas FIG. 2A shows the rudder 6 lowered, FIG. 2B shows rudder 6 raised and lowered in the z axis (FIG. 1). This raising and lowering of rudder 6 varies the effective area of rudder 6. Because rudder area dictates force on rudder 6, the "feel" of rudder 6 sensed by a sailor (not shown) manning tiller 14 can be varied because raising or lowering rudder 6 can change a drive point (FIG. 3) of rudder 6. A drive point is the point at which all the forces on the rudder can be summed. It is somewhat analogous to a center of mass.

Figure 3:
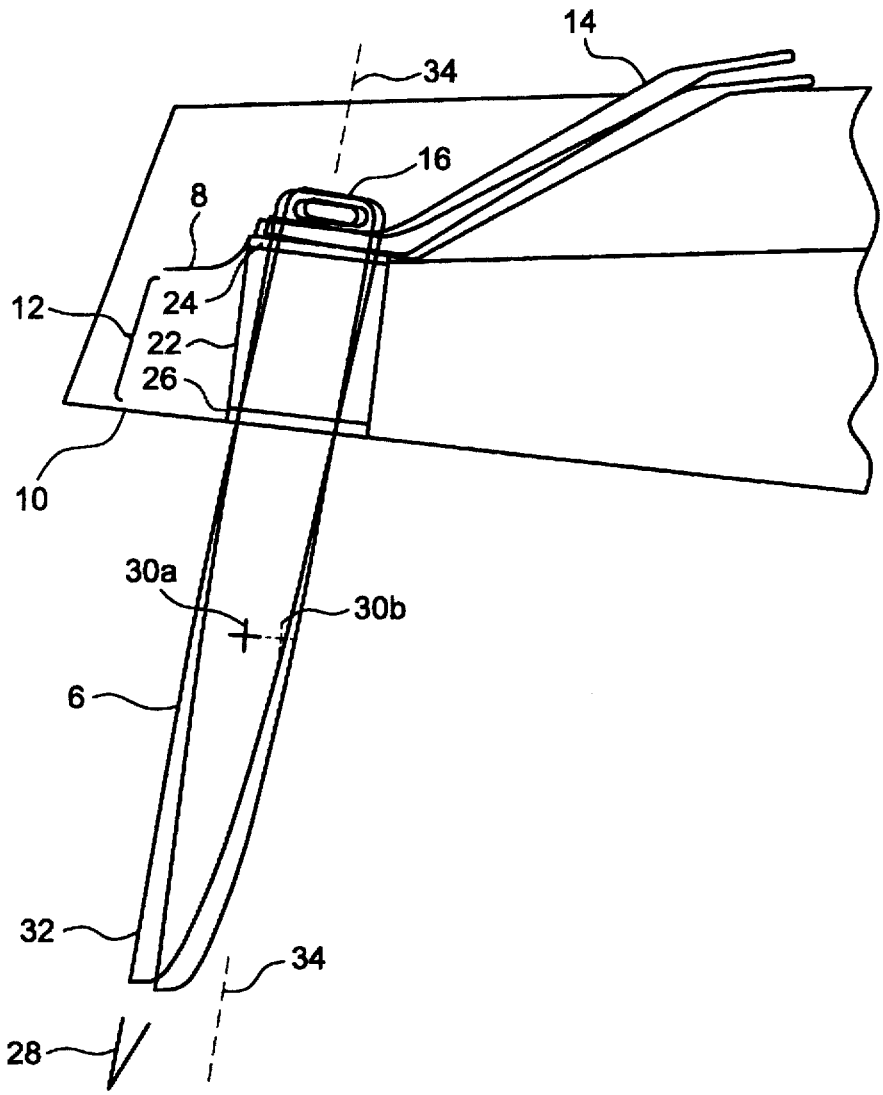
FIG. 3 is a side view of the rudder assembly of the present invention illustrating the sweep angle.

FIG. 3 illustrates a second feature—movement of rudder 6 in the x-z plane (FIG. 1) of the invention and the structure for carrying out that feature. The angle 28 through which rudder 6 sweeps in the x-z plane is called a sweep angle. Changing sweep angle 28 moves the drive point between aft position 30*a* and fore position 30*b*.

Sweep angle 28 of rudder 6 is variable by moving tiller 14 in the fore and aft dimension, away from and toward stern 4.

In FIG. 3, movement of rudder 6 through sweep angle 28 moves a drive point between 30*a* and 30*b* forward and backward and this in turn influences the "feel" of rudder 6 sensed by a sailor. This is another feature of the invention—adjustment of the drive point by changing sweep angle 28 in response to variations in area of rudder 6.

From rudder handle 16 to rudder tip 32 runs an axis 34 which defines the axis of the top and bottom bearing plates 24, 26 looking at rudder 6 in the x-z plane. There is a first drive point 30*b* on rudder 6. If the drive point is at a first distance 36 from the bearing axis 34 a first force is exerted upon rudder 6 and hence the tiller 14 and the drive point is at 30*a*. If rudder 6 is rotated clockwise through sweep angle 28, the drive point is translated to 30*b* where the force upon rudder 6 and hence tiller 14 is greater. This movement of the drive point can be useful to a sailor whose sensitivity to the force on rudder 6 is too low to tell him in what direction if any he should steer the boat 2 (FIG. 1). He can move rudder 6 through the sweep angle 28 until he feels the direction and magnitude of the force on tiller 14.

Figure 4:
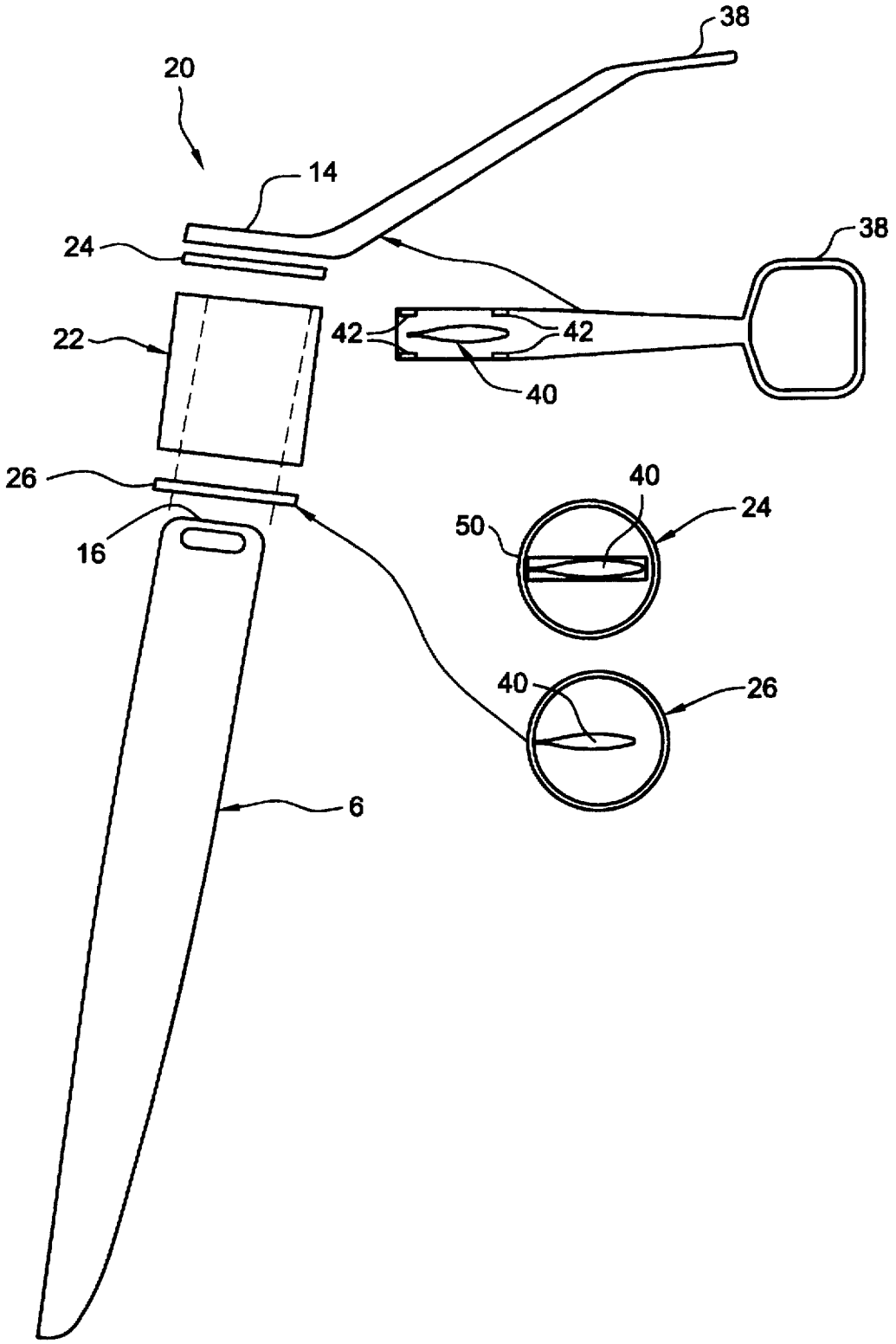
FIG. 4 is an exploded view of the rudder assembly of the present invention.

FIG. 4 is an exploded view of rudder assembly 20. Tiller 14 sits on top bearing plate 24. Rudder 6 passes through tiller 14, top bearing plate 24, tube 22, bottom bearing plate 26, and exits hull 10.

Tiller 14 shows a handle 38 for gripping by a sailor. Tiller 14 has a hole 40 for receiving rudder 6. Tiller 14 has four bolts 42 for connecting tiller 14 to the top bearing plate 24.

Figure 5:
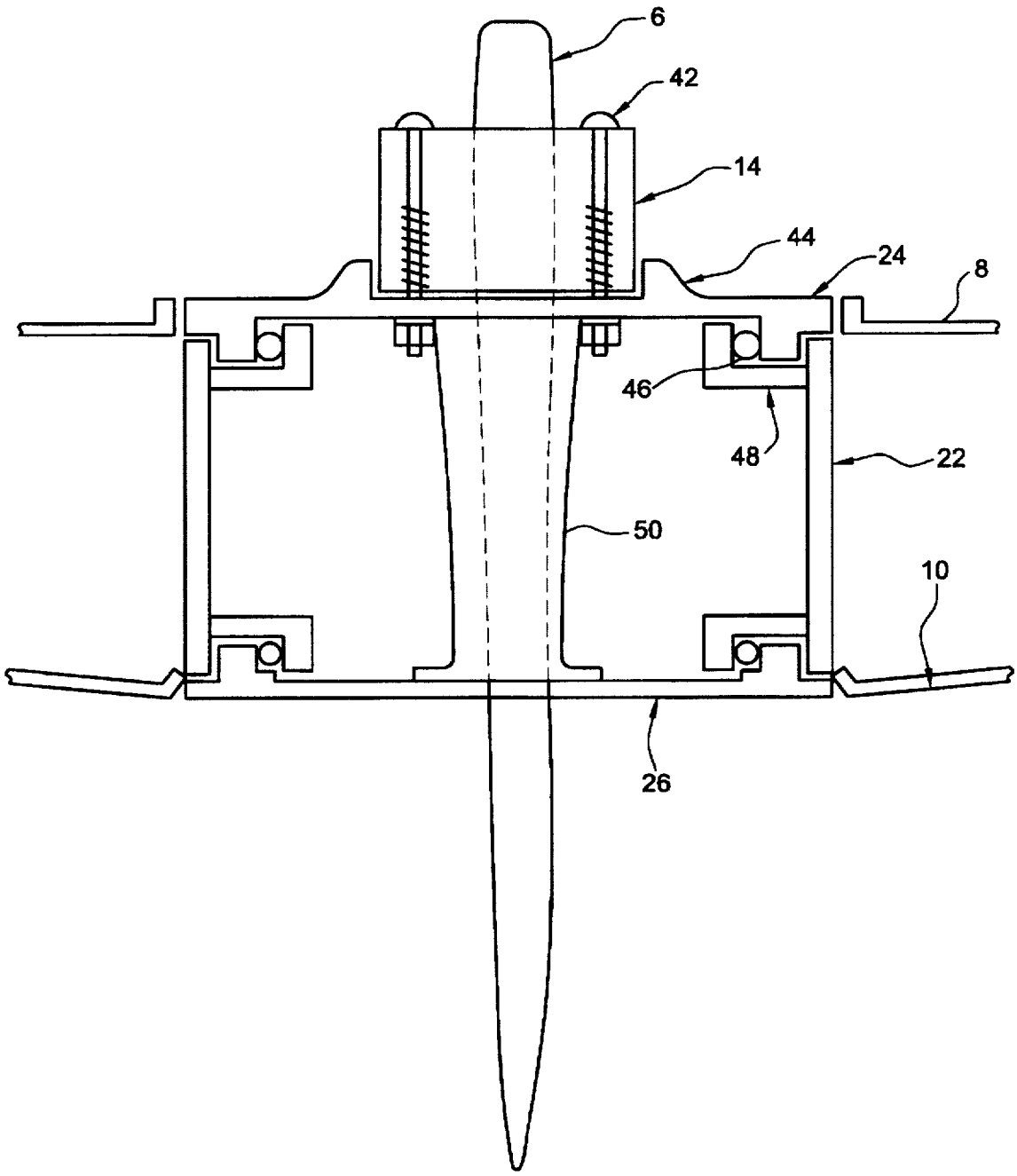
FIG. 5 is a cross sectional view of the rudder assembly of the present invention.

As shown in FIG. 5, a cross-sectional stern view of top bearing plate 24, tiller 14 fits within two tracks 44 on top bearing plate 24. Bearing assembly 12 further includes ball bearings 46 which are sandwiched between a bearing race 48 and top bearing plate 24.

FIG. 5 is a top view of the rudder assembly 29 from the top bearing plate 24 down and shows a hole 40 for harboring rudder 6 as well as a case 50 that connects top bearing plate 24 to bottom bearing plate 26 by bolts 42.

In FIG. 4, beneath tube 22 is bottom bearing plate 26. The top view of that bottom bearing 26 shows hole 40 for rudder 6.

In FIG. 5, from cockpit floor 8, rudder 6 passes through tiller 14 and case 50 that connects top bearing plate 24 to bottom bearing plate 26. Tiller 14 sits within tracks 44 and is bolted 28 to top plate 24 of bearing assembly 12. Bearing assembly 12 includes top and bottom bearing races 48 for holding ball bearings 46 which are sandwiched between the races 48 and top and bottom plates 24, 26.

Figure 6:
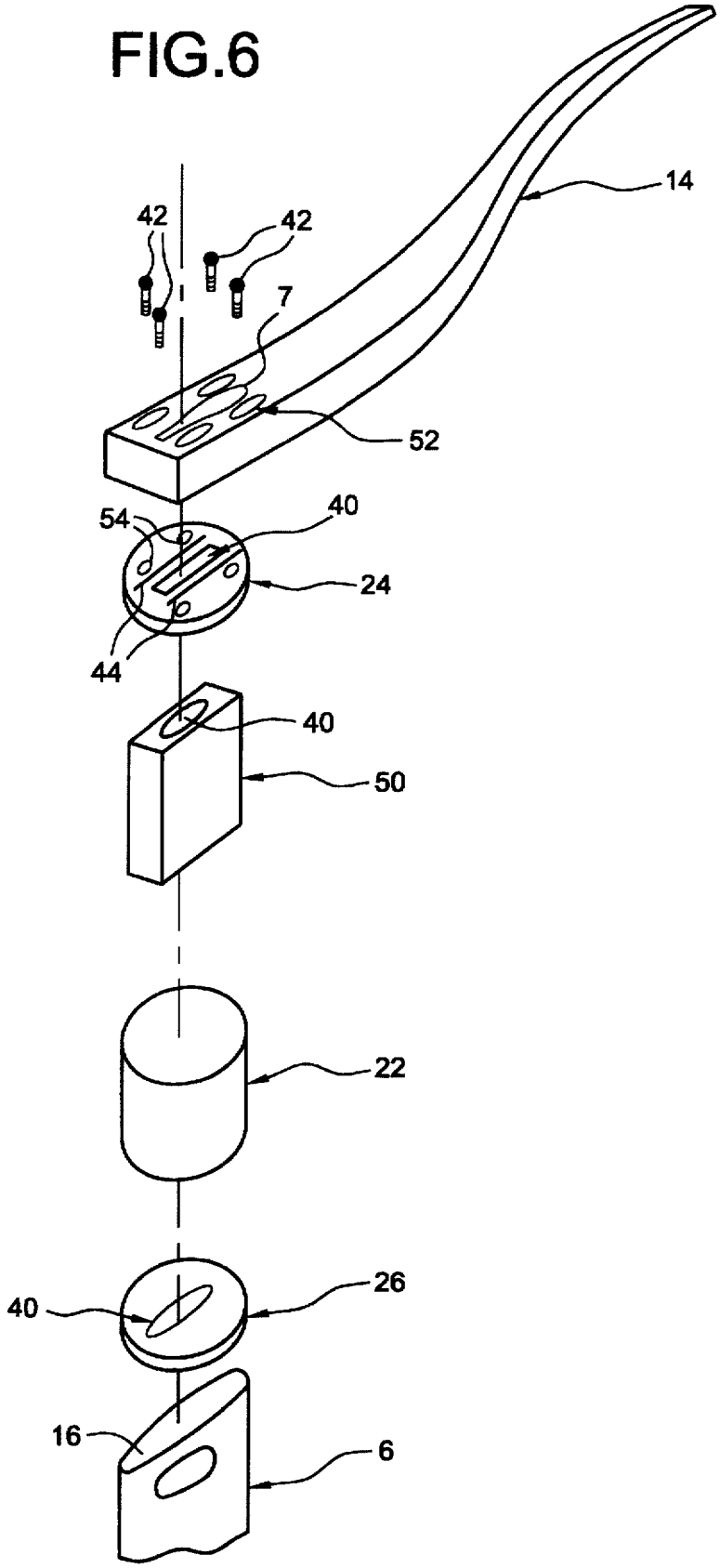
FIG. 6 is a second exploded view of the present invention.

FIG. 6 shows another view of the invention. From top to bottom, tiller 14 fits within two tracks 44 on top bearing plate 24 and is bolted 42 to top bearing plate 24 through bolt holes 52. Case 50 secures top bearing plate 24 to bottom bearing plate 26. Case 50 harbors within tube 22. Each of tiller 14, top bearing plate 24, case 50, and bottom bearing plate 26 includes hole 40 for receiving rudder 6. Bolt holes 54 in tiller 14 are large to allow adjustment of the sweep angle 28.

Figure 7:
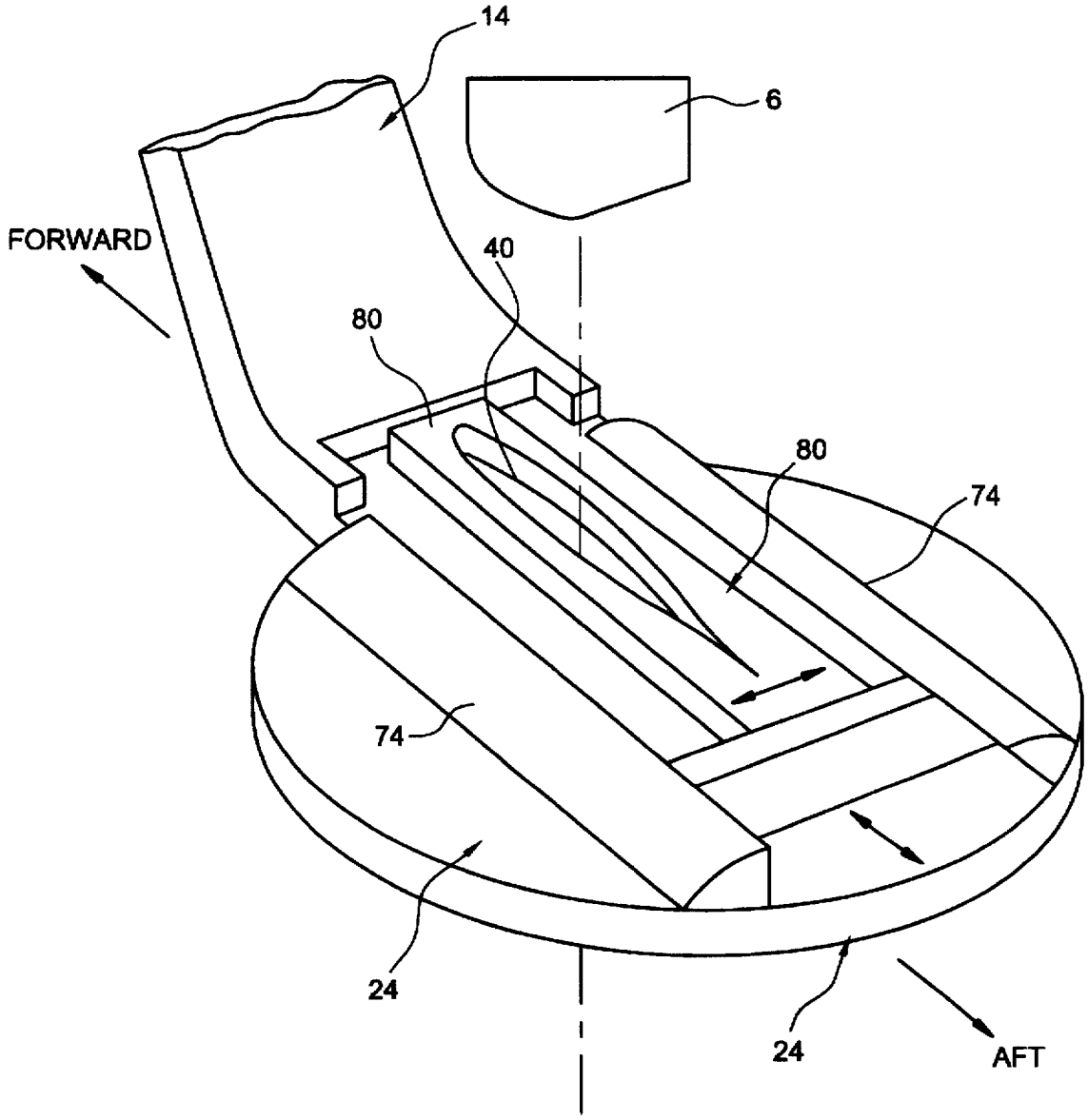
FIG. 7 is a second embodiment of the rudder assembly of the present invention.

FIG. 7 shows a second embodiment of the invention illustrating control of rudder 6 in three directions. First, tiller 14 slides within tracks 74 for controlling movement along a first horizontal axis. This movement may be but need not be in the fore and aft direction as shown in FIG. 3. Second, rudder 6 can be inserted into hole 40 formed by a slidable plate 80. Plate 80 can slide parallel to top bearing plate 24 along an axis perpendicular to the axis defined by tracks 74. Third, as shown in FIGS. 1–6, rudder 6 can be rotated in directions 82.

Figure 8:
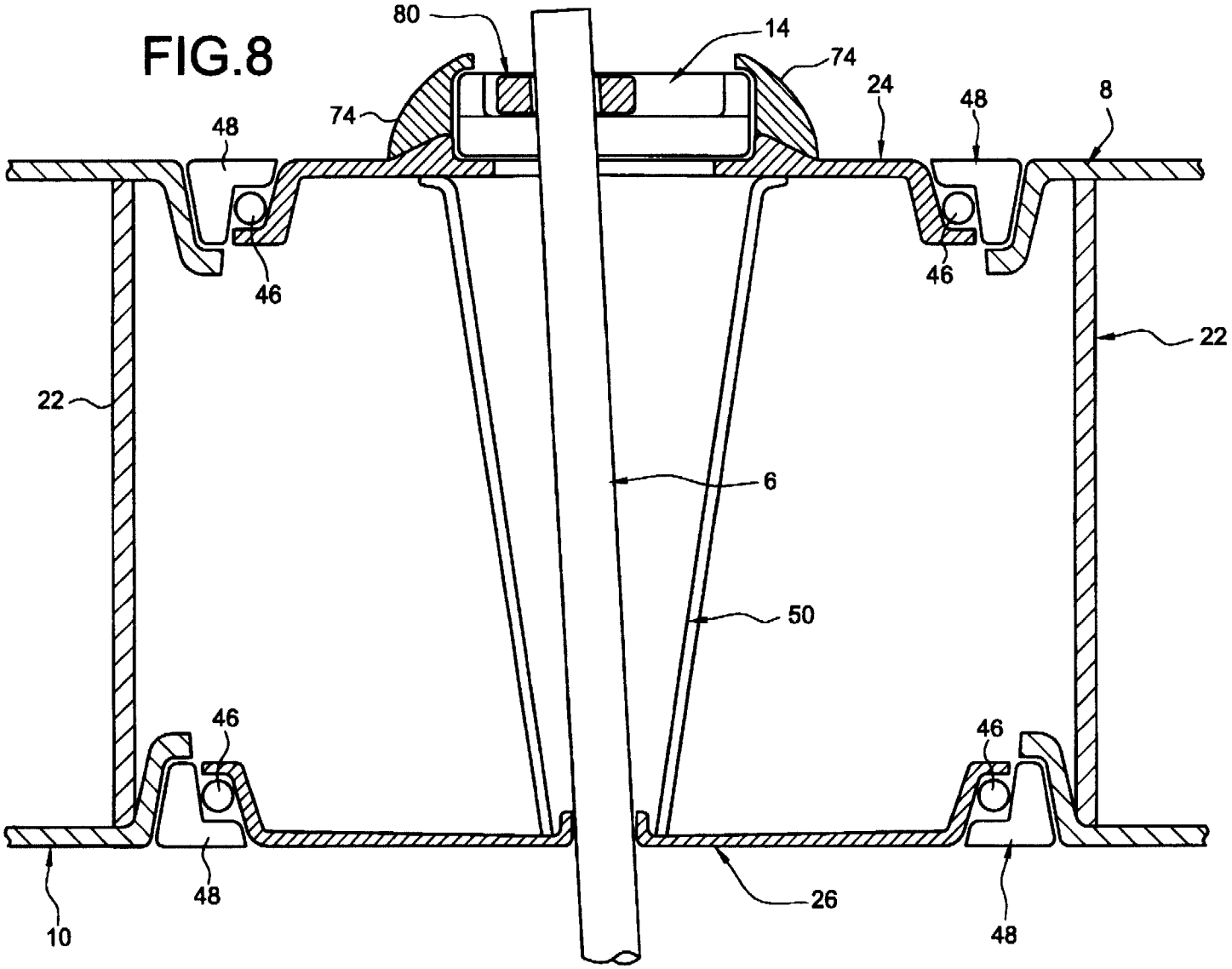
FIG. 8 is a cross-sectional view of the rudder assembly of FIG. 7.

FIG. 8 is a view from stern 4 of the rudder assembly of FIG. 8 wherein rudder 6 rotates in the plane of the drawing as slidable plate 80 slides left and right within walls 84 between tracks 74. Rudder 6 harbors within tube 22 which itself extends between hull 10 and cockpit floor 8. Rotation of top bearing plate 24 occurs by bearings 46 which sit on races 48. Case 50 connects top bearing plate 24 to bottom bearing plate 26. Rudder 6 is fixed at the bottom of case 50 but free to rotate in the plane of the page at the top of the case 50.

The features of the invention lead to better sailing, over boats using prior art rudders, under a variety of conditions. Imagine two sailors. Each goes to a boat shop to buy a boat so that they can race. A first sailor buys a boat with the present invention and saves money because he does not pay for a rudder post. A second sailor buys a boat with a prior art rudder and rudder.

Second, because the rudder assembly of the present invention can be raised or lowered out of the stern, transporting the boat to the water is easier because the rudder can be stored in a protected box alongside the hull whereas a prior art rudder might be fixed to the bottom of the hull. If the two boats race, more advantages to the invention become apparent. When the start gun goes off, the sailor with the invented rudder can vary the effective area of the rudder and the sweep angle of the rudder, respectively reducing drag and enabling the sailor to better feel through the tiller in his hand the forces on the rudder and therefore the direction and speed of the boat.

Drag reduction through variation of rudder effective area is further explained. When sailing in a light wind the amount of force that the rudder needs to exert against the water for maximum control and speed is small. But in a heavy wind, more force is needed. Rudder designers in the past sensibly designed the rudder to have a great area to handle the maximum load so that the boat does not go out of control in a heavy wind. The present invention recognizes that in a light wind this great area is not needed and only results in drag. Accordingly, a first sailor sailing a first boat using the present invention racing against a second sailor sailing a second boat using a prior art rudder would lose because in a light wind the first sailor could raise the rudder and eliminate the drag causing the first boat to speed up.

Increased sensitivity to the rudder forces through variation of the sweep angle is further explained. Humans are not infinitely sensitive to physical changes such as changes in the force on a tiller. Under certain sailing conditions, both the first and second sailor may have difficulty sensing the force on the rudder. Without that information, neither will at that moment be able to decide in which direction to move the rudder. The second sailor will have to wait until sailing conditions change to give him the information he needs to make that decision. While the second sailor is waiting the first can alter the sweep angle of the rudder thereby moving the drive point on the rudder and thereby increasing the force on the rudder and therefore the force on the tiller which the first sailor senses with his body. By changing the sweep angle, the first sailor can acquire the information he needs to decide how to control the rudder.

Because the sailor who can vary the sweep angle can better feel the rudder forces, he can steer a more accurate and therefore faster course than the sailor using the prior art rudder.

The two boats round a first mark and change direction in the point of sail or the trajectory of the wind to the boats. For instance, the first leg was against the wind making the rudder act as a lifting force or wing. During the second leg (with the wind), this lift is not required and control and reduced drag are required. On this second leg of the race, downwind, the rudder of the invention is raised enough that there is enough rudder to steer the boat but drag is lessened. The other sailor using the prior art rudder does not have this feature and falls behind. A third leg of the race is back up wind or against the wind, and the wind has increased. Now, the rudder of the present invention is tilted so it is more vertical to compensate for present heeling of the boat. The second sailor using the prior art rudder does not have this feature and he has less rudder to control the boat during heeling of the boat. Further, because boat speeds have increased in response to increased windspeed and the fact that reaching is almost always the fastest point of sail, the rudder of the present invention can be raised because the aforementioned lift is not a concern as there is enough water going past the rudder that there is less need for a large rudder effective area. Raising the rudder in this case reduces drag that the second sailor using the prior art rudder cannot reduce. The first sailor using the present invention wins the race on the first day and raises his rudder to store it in a dry, clean environment. If there is a second day of racing, the sailor using the present invention starts with a clean rudder. The prior art rudder is left sitting in the water collecting algae and living and non-living debris and the sailor using that prior art rudder must either waste his time cleaning that debris or accept the fact of dragging that debris through the race. In addition, the present invention allows for rudders of different sizes and weights to be inserted into hole 40 much like a golfer uses different clubs on holes of a golf course.

It will be appreciated by those skilled in the art that various changes and modifications may be made to the specifications and drawings without departing from the spirit and scope of the present invention.

We, Paul Amon and Glenn Henderson, claim as our invention:

1. A rudder assembly for inserting into the stern of a boat for steering the boat in water, comprising:

a postless rudder having a bottom for extending into the water and steering the boat in the water;

a bearing assembly inserted into the stern of the boat such that it extends from a hull of the boat to a cockpit floor of the boat, said bearing assembly rotatably collaring said rudder such that said rudder is rotatable about a substantially vertical axis within said bearing assembly for steering of the boat.

2. The rudder assembly of claim 1, further comprising a tiller mounted on top of said rudder such that movement of the tiller causes rotation of said rudder.

3. The rudder assembly of claim 1, wherein said rudder further comprises a handle at the top of said rudder such that the rudder can be raised or lowered, more or less, into or out of the water, so that the area of the rudder in contact with the water is variable.

4. The rudder assembly of claim 1, further including means for moving the rudder in a plane perpendicular to said bearing assembly such that said rudder may rotate about a substantially vertical axis, rotate about an axis parallel to the length of said boat or rotate about an axis parallel to the width of said boat.

5. The rudder assembly of claim 1, further comprising a clearance between said rudder and said bearing assembly for moving the rudder in a plane perpendicular to said bearing assembly.

6. An inboard rudder assembly for insertion into a boat stern, comprising:

an inboard rudder;

a bearing assembly extending from a cockpit floor of said boat to a hull of said boat, said bearing assembly having a first hole which extends the entire length of said bearing assembly, said hole for harboring said rudder, said bearing assembly further including a top bearing plate which rides on bearings which sit in a bearing race near the cockpit floor, said top bearing plate having a second hole coaxial with said for hole for harboring said rudder;

a bottom bearing plate which rides on bearings which sit in a bearing race near the cockpit floor, said bottom bearing plate having a third hole coaxial with said first and second holes for harboring said rudder;

wherein said top and bottom bearing plates are rigidly connected to one another such that said top bearing plate and bottom bearing plate rotate in unison.

7. The inboard rudder assembly of claim 6, wherein said first hole is larger than said second hole such that the top of said rudder near the cockpit floor can be rotated while the bottom of said rudder near the hull is relatively fixed.

8. The inboard rudder assembly of claim 6, wherein said rudder includes a handle at the top of said rudder near the cockpit floor so that said rudder may be raised or lowered into or out of the water.

9. The inboard rudder assembly of claim 6, wherein said rudder is controlled by a tiller disposed near the top of said rudder near the cockpit floor, said tiller being slidable parallel to said top bearing plate within tracks defining a first axis, said tiller including a slidable plate which slides in a direction perpendicular to said first axis, said slidable plate having a fourth hole—coaxial with said first, second and third holes—in which said rudder harbors.

* * * * *